US008961267B2

(12) United States Patent
Monnoyeur

(10) Patent No.: US 8,961,267 B2
(45) Date of Patent: Feb. 24, 2015

(54) OPHTHALMIC MACHINE AND METHOD FOR MACHINING AND/OR POLISHING A LENS

(76) Inventor: Guy Monnoyeur, Songeson (FR)

( * ) Notice: Subject to any disclaimer, the term of this patent is extended or adjusted under 35 U.S.C. 154(b) by 971 days.

(21) Appl. No.: 13/126,865

(22) PCT Filed: Oct. 28, 2009

(86) PCT No.: PCT/FR2009/052076
§ 371 (c)(1),
(2), (4) Date: Jun. 9, 2011

(87) PCT Pub. No.: WO2010/049645
PCT Pub. Date: May 6, 2010

(65) Prior Publication Data

US 2011/0256806 A1 Oct. 20, 2011

(30) Foreign Application Priority Data

Oct. 29, 2008 (FR) ..... 08 57364
Feb. 6, 2009 (FR) ..... 09 50763

(51) Int. Cl.
*B24B 13/00* (2006.01)
*B24B 13/005* (2006.01)
*B24B 13/06* (2006.01)

(52) U.S. Cl.
CPC ..... *B24B 13/0055* (2013.01); *B24B 13/0031* (2013.01); *B24B 13/0052* (2013.01); *B24B 13/06* (2013.01)
USPC ..... 451/10; 451/42

(58) Field of Classification Search
CPC ..... B24B 13/005; B24B 13/00; B24B 13/06
USPC ..... 451/42, 5, 9, 10, 11, 388
See application file for complete search history.

(56) References Cited

U.S. PATENT DOCUMENTS

| | | | | |
|---|---|---|---|---|
| 4,277,916 | A * | 7/1981 | Buhler | 451/384 |
| 5,005,633 | A * | 4/1991 | Mathews et al. | 164/334 |
| 6,012,965 | A | 1/2000 | Savoie | |
| 6,568,990 | B2 * | 5/2003 | Siders et al. | 451/5 |
| 6,785,585 | B1 | 8/2004 | Gottschald | |
| 2004/0142642 | A1 | 7/2004 | Thepot et al. | |
| 2005/0221721 | A1 | 10/2005 | Valle et al. | |
| 2008/0051012 | A1 | 2/2008 | Akiyama et al. | |

FOREIGN PATENT DOCUMENTS

EP 1 762 337 A1 3/2007

* cited by examiner

*Primary Examiner* — Robert Rose
(74) *Attorney, Agent, or Firm* — Laurence A. Greenberg; Werner H. Stemer; Ralph E. Locher

(57) ABSTRACT

The invention relates to an ophthalmic machining machine comprising machining means and means for supporting a blank. The invention is characterized in that the machine is capable of transferring marks to said blank that can be identified by monitoring means for repositioning the blank on said supporting means after machining the opposite surface. The invention also relates to a workholding tool. The invention is characterized in that said supporting means are mounted on a bearing surface, which is oblique in relation to a surface of a carriage, by depression of an opening surrounded by an O-ring seal and a fixed bearing. The invention also relates to a machining method according to which the markings are transferred to a blank, the position of said markings is assessed by monitoring means which position machining means for the machining process, and each surface of the resulting lens is polished with polishing means.

14 Claims, 3 Drawing Sheets

OPHTHALMIC MACHINE AND METHOD FOR MACHINING AND/OR POLISHING A LENS

BACKGROUND OF THE INVENTION

Field of the Invention

The invention relates to an ophthalmic machine for machining and/or polishing a lens or plastic blank, comprising at least one machining and/or polishing tool, machining means for machining along a first axis that are designed to be able to drive said tool, workpiece supporting means on which are placed holding means for holding at least one blank in place, which blank has a first face and a second face opposite each other, and means for inverting said blank so as to allow it to be machined on each of said faces.

The invention also relates to a workpiece holding tool for holding a blank.

The invention also relates to a method of machining and polishing optical or ophthalmic lenses made of mineral or organic glass.

The present invention relates to the field of manufacturing optical components, in particular rigid or flexible lenses, or contact lenses, or components having polished final surface finishes, such as mirrors, flasks or the like.

More particularly, the invention relates to an ophthalmic machine for machining and/or polishing a mineral or organic glass lens blank, more precisely ophthalmic or optical lenses, and to an associated method.

A machining machine for optical applications is already known from document EP-A 0 281 754, which can be used for producing aspheric, concave or convex surfaces, progressive surfaces, or variable-power surfaces, either on a block of material suitable to serve thereafter as a mold for the production of an ophthalmic lens by molding an organic material or directly from a blank. Such a machine has three axes, namely two linear axes and one rotary axis, on which a workpiece holding tool is mounted. The movements of the axes are used to obtain the desired path, in particular a spiral path, of a tool on the surface of the workpiece to be machined, and according to the pass depth, that is to say the amount of material that the tool has to remove in sequence at points successively spaced apart along the spiral path. The carriage that supports the workpiece holder must therefore undertake an oscillating rectilinear movement, the amplitude of which may reach high values, especially if the optical surface to be machined has radii of curvature very different in value between the equatorial plane and the principal meridional plane of the surface to be machined. By successive 90° rotations of the workpiece holder about an axis, the point of contact between the tool and the surface to be machined passes from the equatorial plane to the principal meridional plane and then again to the equatorial plane, and so on.

Such an operating mode is unfavorable from the standpoint of machining precision, machining time and freedom of choice of the machining path or other machining parameters.

The main drawback is that of making up the slack upon inversion, when switching over on a given axis, resulting in a surface finish defect and in a visual mark on the machined workpiece, something which is not admissible.

The machining precision and the machining time are too very intimately connected quantities: the slower the rate of displacement or oscillation of the tool or of the workpiece holder, the more the machining time increases but the greater the precision.

In addition, on such a machine of the prior art, a lens blank must be inverted, after machining of the first face, for the purpose of machining the opposite face. The operation of repositioning the machining head is not perfect, thereby requiring the path of the tool to be completely recalculated so as to avoid any coaxiality defect on the two faces of the lens.

BRIEF SUMMARY OF THE INVENTION

The object of the present invention is therefore to provide a machine that allows very high machining precision to be achieved, with a short machining time, and which gives greater freedom as regards the choice of path of the machining tool, making it possible to choose a machining strategy capable of eliminating any surface finish defect.

For this purpose, the present invention relates to an ophthalmic machine for machining and/or polishing a lens or plastic blank, comprising at least one machining and/or polishing tool, machining means for machining along a first axis designed to be able to drive said tool, workpiece supporting means on which are placed holding means that are for holding at least one blank in place, which blank has a first face and a second face, and means for inverting said blank so as to allow it to be machined on each of said faces, characterized in that said machining means are designed so as to be able to transfer marking means onto said blank, these marking means being able to be recognized or identified by monitoring means that said ophthalmic machine has for repositioning said blank on said holding means after the opposite face has been machined.

According to one feature of the invention, the ophthalmic machine includes polishing means for driving at least one polishing fixture along a second axis parallel to or coincident with said first axis of said machining means.

The invention also relates to a workpiece holding tool for holding a lens blank in the form of a spherical cap or the like, characterized in that it includes, mounted on a bearing surface oblique to a mounting surface that said workpiece holding tool has for being mounted on a platform or on a carriage, means for holding said blank, these means being designed to hold at least one blank in place by a vacuum at an orifice around which are positioned, on the one hand, at least one O-ring seal designed so as to be able to create a vacuum-tight volume for holding a said blank, and, on the other hand, at least one fixed bearing member designed so as to be able to support the same blank in the vicinity of the largest diameter of the latter, said O-ring seal being designed to be able to deform under the effect of a vacuum applied to said orifice without at any moment deforming a blank positioned so as to bear both on said fixed bearing member and on said O-ring seal.

The invention also relates to a method of machining and polishing optical or ophthalmic lenses made of mineral or organic glass, characterized in that:

- marking means are transferred onto a blank before, during or after machining;
- the position of said marking means is evaluated by the agency of monitoring means that said machine has, these means being designed so as to be able to position machining means along a first axis in order to machine said blank;
- said blank is machined with said machining means; and
- after machining, each face of the lens obtained is polished with polishing means.

Other objects, advantages and features of the invention will become apparent on reading the following description of one embodiment of a machine, a workpiece holding tool designed so as to be able to further improve the performance of this machine, and a method according to the invention, for machining ophthalmic or optical lenses, in conjunction with the appended figures in which:

DESCRIPTION OF THE INVENTION

Figure 1:
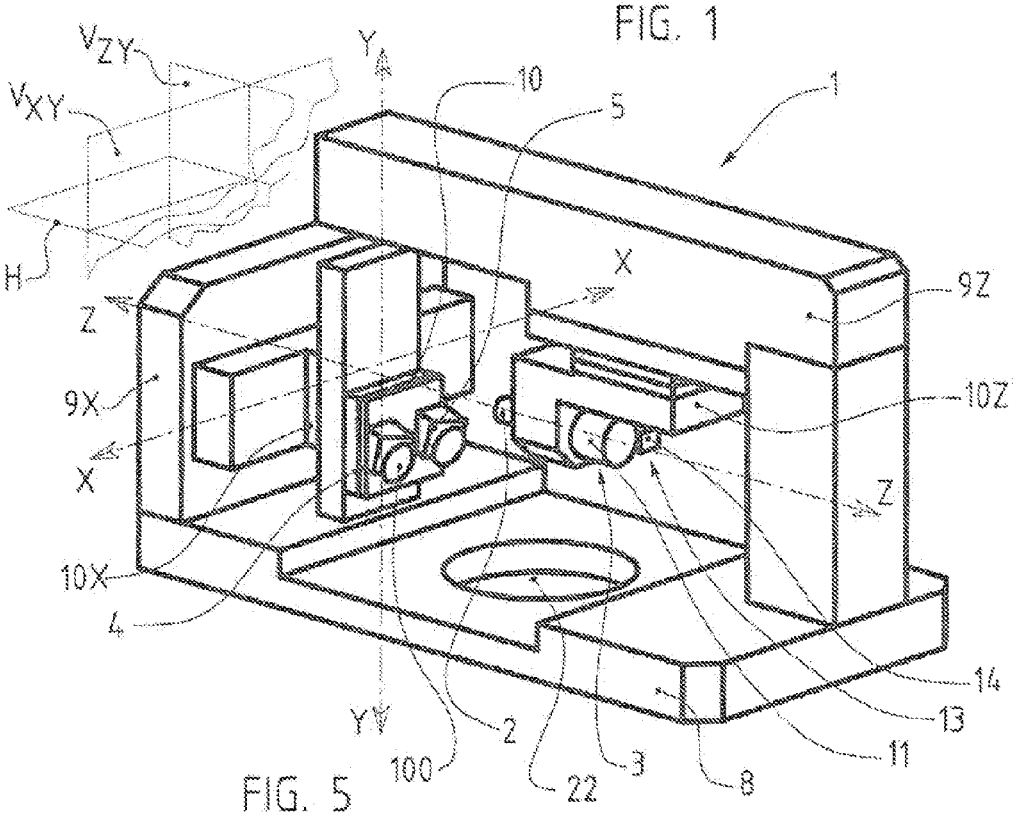
FIG. 1 is a schematic view in perspective of a machine according to the invention.

The present invention relates to an ophthalmic machine 1 for machining and polishing a mineral or organic glass, or plastic, lens blank, especially ophthalmic lens blank, comprising at least one machining and/or polishing tool 2, machining means 3 designed so as to be able to drive this tool 2 along a first machining axis Z1, and workpiece supporting means 4.

The present description relates more precisely to the preferred use of producing optical components, either, in particular, rigid or flexible lenses, or contact lenses, or else spectacle frame elements, for the production of which the invention is particularly well suited. It will be understood that the invention can also be used for many applications for the production of surfaces requiring a very fine, in particular polished, surface finish on objects having different faces to be machined by inversion, such as flasks, medals, molds, jewelry or the like.

Placed on these workpiece supporting means 4 are holding means 5 designed so as to be able to hold at least one blank 100 in place. The blank has at least a first face 101 and a second face 102 opposite each other.

Advantageously, the ophthalmic machine 1 includes means for inverting such a blank 100 so as to allow it to be machined on each of the faces 101 and 102.

According to the invention, the ophthalmic machine 1 is designed so as to allow production of marks that can be used to guarantee perfect repositioning upon inverting the blank, in order to pass from machining the first face 101 to that of the second face 102, or conversely. For this purpose, the machining tool 2 is designed so as to be able to transfer onto the blank 100 marking means that can be recognized or identified by monitoring means that the ophthalmic machine 1 has for allowing the blank 100 to be repositioned on the holding means 5 after the opposite face has been machined.

In the rest of the description, it should be understood that the term "first face" means the first face machined, whether concave or convex in the particular case of a lens. Of course, this does not prevent the machine from returning to the first face after the second face has been machined.

The monitoring means may comprise first monitoring means 6 located on an axis Z3 of the machine, preferably parallel to or coincident with the first axis Z1, and second monitoring means 7 located on the holding means 5, such as a workpiece holding tool. These second monitoring means 7 may advantageously include position-monitoring means, particularly centering pins or the like.

The ophthalmic machine 1 is designed, as may be seen in FIG. 1, in the manner of a machine tool such as a machining center. It includes a main platform 8 which itself supports secondary platforms 9 themselves supporting carriages 10, which are oriented in a direct orthogonal Cartesian reference system along the axes X, Y and Z, the latter axis Z being parallel to or coincident with the first axis Z1, and with, for each of these axes, at least one carriage, respectively 10X, 10Y, 10Z. The axes X and Z define a horizontal plane H, the axes X and Y define a first vertical plane Vxy and the axes Z and Y define a second vertical plane Vzy.

Advantageously, for better vibration damping and for excellent machining and monitoring reproducibility, the machine is designed in the form of a granite portal supported by a bench, which is itself made of granite.

The carriages are advantageously moved along axes X, Y and Z by linear motors. In this way, the mechanical stresses generated by nut-screw systems of the prior art are avoided, and the precision is greater. The measurement rules and the associated electronics are integrated into these motors; the precision and at the same time the dynamics of the machine are thereby improved.

A secondary platform 9Z along the axis Z, corresponding to the machining means 3, includes driving means, preferably formed by such a linear motor, at least one carriage 10Z designed so as to be able to carry a machining spindle 11, including a tool holder 12, in which a tool 2 is mounted, thus moving along the first axis Z1 parallel to or coincident with the axis Z of the ophthalmic machine 1.

The secondary platform 9Z thus supports one or more carriages 10Z, each designed so as to be able to carry machining means 3, and/or first monitoring means 6 and/or polishing means 13. The use of separate carriages makes it possible for secondary axes, such as the first machining axis Z1, a second, polishing axis Z2 parallel to or coincident with the first axis Z1, and a monitoring axis Z3 parallel to or coincident with the first axis Z1, to be independently controlled.

Figure 4:
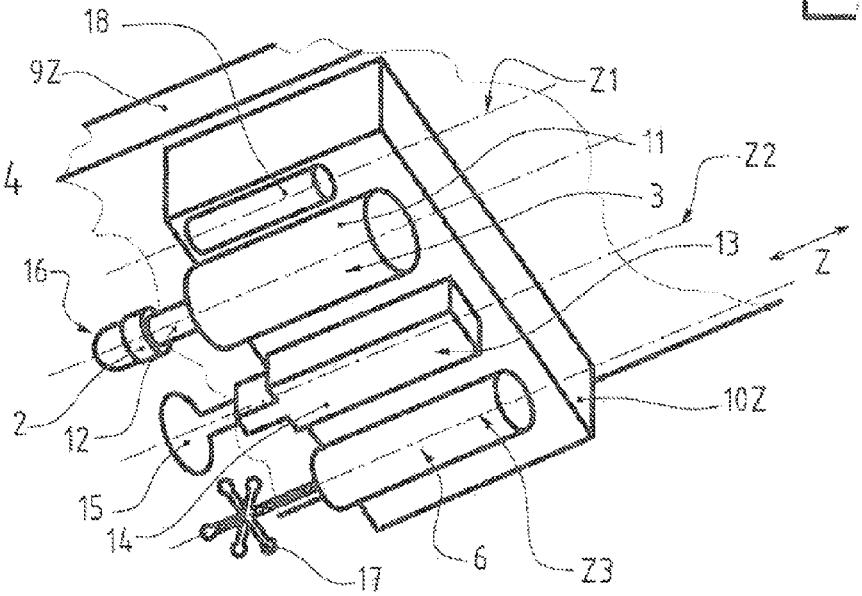
FIG. 4 is a schematic view from beneath of a carriage that said machine includes along a first axis Z, which carriage is designed to be able to support machining and/or polishing means.

This embodiment is, however, expensive. In a more economical embodiment, as may be seen in FIG. 4, the carriage 10Z advantageously groups together, juxtaposed along axes Z1 and/or Z3 and/or Z2, parallel to one another, machining means 3 and/or first monitoring means 6 and/or polishing means 13.

This preferred embodiment requires only for the ophthalmic machine 1 to have sufficiently large dimensions, in particular as regards its travel along the axes X, Y and Z in order to avoid any risk of interference between, on the one hand, the machined workpieces or blanks 100, their holding means 5 and the supporting means 4 and, on the other hand, the machining means 3, and/or first monitoring means 6 and/or polishing means 13, and, of course, the respective carriages on which these various elements are placed. The position of each of the means, and therefore of each tool 2, is therefore perfectly known. Naturally, it is possible to equip the ophthalmic machine 1 with tool-changing means, whether manual or automatic, irrespective of whether this is for the machining means 3 and/or first monitoring means 6 and/or polishing means 13. For the same purpose of simplifying the ophthalmic machine 1, it may be less expensive to duplicate certain of these means, each then being provided at its ends with a different tool.

Figure 3:
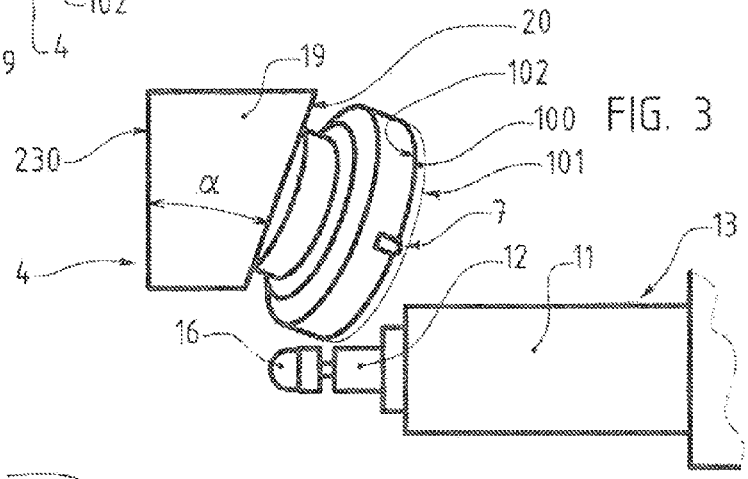
FIG. 3 is a schematic view of machining means that said machine includes, these means carrying a machining tool, in the machining position.

The machining means 3, in a nonlimiting embodiment, consist of at least one machining spindle 11 or an electro-spindle, or the like, driving a machining tool 2, such as a milling cutter or a grinder, for example a ball milling cutter 16 as can be seen in FIG. 3, or else any suitable tool, having a cylindrical or conical shape, or a shape suitable for the machining operations to be carried out. Preferably, the tool 2 is chosen to be sufficiently multi-purpose in order to allow both machining firstly of the first face 101 and secondly of the second face 102 of a blank 100.

Advantageously, a machining tool 2 having a hemispherical end-piece is used, making it possible to machine the entirety of a complex warped surface and working, when this is possible, on the part of it which is furthest away from its principal axis, in order to achieve the highest possible peripheral speed and therefore machining of higher quality.

Advantageously, in the case of optical lenses intended to be fitted onto spectacle frames or the like, so as to avoid a lengthy subsequent contouring machining operation requiring the removal of a lot of material, the external form of the lens along its edge is machined on the ophthalmic machine 1 with the same tool 2 serving to machine its faces, and in particular the blank tool in the case in which several successive tools are used. For this purpose, it is preferred to use a tool 2 having a cylindrical part, for example following on from a hemispherical end-piece.

Likewise, if the edge of the lens has to be given a beveled profile, the ophthalmic machine 1 may be used as an optician's edging machine. A tool 2 having one or more cutting edges or surfaces having a shape complementary to the profile of the bevel is then used.

The first monitoring means 6 may be of contacting or contactless type, for example of the optical, ultrasonic, tactile or inductive type such as "Renishaw" feelers or the like, and may include an end-piece 17 such as what is called a star end-piece, conventional on measurement centers and on machining machines for three-dimensional measurements. These first monitoring means 6 make it possible to verify each machining operation, or successive machining operations if this is the case, and correct repositioning of the blank after its inversion. They make it possible to provide the offsetting values for the origin and/or the inclination of the axes to be taken into account during any recalculation of the path of the machining tool or of the polishing tool.

Preferably, the ophthalmic machine 1 includes an etching and/or monitoring laser head designed so as to be able to verify and/or index and/or monitor the marking means transferred by the machining tool 2. It will be understood that the ophthalmic machine 1 is designed so as to be able to transfer marking means onto the blank 100, which means may be produced by the machining means 3 or else by ancillary means such as an etching laser head of this type. The first monitoring means 6 may also incorporate such a laser head in order to verify and/or index and/or monitor these marking means.

Advantageously and innovatively, the polishing means 13 may include a laser with quite a broad beam, i.e. a few square millimeters in cross section, which makes it possible to provide a perfect finishing operation after machining. The same laser may also be used for etching or similar tasks.

These marking means are transferred in the form of indexations made on the first face 101 and/or on the second face 102, for example by etching marks, lines, patterns, barcodes or the like, or on another surface of the workpiece to be machined, such as the edge of a lens, in the form of notches or the like.

The carriage 10Z along the axis Z may also include ancillary machining means, such as a small drilling spindle or the like, designed so as to be able to carry out particular machining operations, such as that of drilling holes on spectacle lenses, without setting down the blank.

Advantageously, the ophthalmic machine 1 includes, on the axis Z, polishing means 13 for driving at least one polishing end-piece 15 along a second axis Z2 parallel to or coincident with said first axis Z1 of the machining means 3. These polishing means 13 allow the complete manufacture to be terminated thereby, in particular in the case of an optical lens. Preferably, these polishing means 13 include at least one ultrasonic head 14 carrying a polishing end-piece 15, if necessary by the intermediary of a tool holder. This ultrasonic head 14 makes it possible to polish the machined workpiece, after the finishing machining with the milling cutter and/or the grinder, with point-by-point displacements, on each of its faces. The ultrasonic head 14 serves, in a preferred but nonlimiting application, to vibrate the end-piece 15 at an ultrasonic frequency, especially between 10 and 30 kHz, which is preferably chosen to be close to 25 kHz for a good compromise between noise and quality. The vibration at ultrasonic frequency may in particular be generated by an excitation means delivering a sinusoidal signal to a converter consisting of at least two piezoelectric ceramics constrained between two metal masses, which ceramics deform and contract according to the frequency of the delivered sinusoidal signal. The resonant frequency of the metal masses coincides with the frequency of this signal, this having the consequence of amplifying the vibration movement of these masses. Their vibrations are transmitted to the end-piece 15, if necessary with the interposition of an amplifier. A relative penetration movement of the end-piece 15 into the blank 100 is carried out along the second axis Z2 until the end-piece 15 has reached a defined depth. The rate of penetration is chosen according to the nature of the blank 100.

Advantageously, the polishing means 13 may be used on each machined face before the blank is inverted. To avoid creating defects between the machining, polishing and inversion phases, the ophthalmic machine 1 is advantageously equipped with means for cleaning by washing and/or with means for lubrication, blowing, ultrasonic cleaning, or the like.

The ophthalmic machine 1 also advantageously includes at least one cooling unit, in particular for cooling the lubricating fluid used for the machining, which fluid may also be used for cooling electro-spindles or other machining means and, if desired, for stabilizing the temperature of the platforms and the carriages.

To ensure no vibration combines with the two other axes X and Y, the various active means, i.e. the machining means 3 and/or the polishing means 13, are mounted only on the carriage 10Z of the axis Z, or on separate carriages equipping the secondary platform 9Z of the axis Z.

In a preferred, nonlimiting, embodiment, the main platform 8 bears a secondary platform 9X which itself supports at least one carriage 10X that can move along the horizontal axis X. The carriage 10X itself bears at least one carriage 10Y that can move along the axis Y. This carriage 10Y in turn bears workpiece supporting means (4) bearing holding means 5 for holding at least one blank 100. If the travel of the carriage 10X along the axis X is sufficient, two blanks 100 may be machined simultaneously.

This architecture is preferred for producing the ophthalmic machine 1, in its application for machining optical lenses in pairs, in the form of a compact machine not exceeding the footprint of a standardized palette, and not having any particular civil engineering requirement, it being possible for the main platform 8, on the contrary, to be designed so as to be able to be moved. Other architectures are conceivable, but they result in making the machine costlier or giving it a much greater overall volume.

According to the invention, the workpiece supporting means 4 preferably comprise at least one workpiece holding tool 19. This has an oblique bearing surface 20 inclined to a mounting surface 230 that this workpiece holder 19 has for being mounted on a platform or a carriage, at a first angle $\alpha$ to the axis Y orthogonal to the axis Z1 in a plane Vzy, and at a second angle $\beta$ to the axis X orthogonal to the axis Z1 and to the axis Y in a plane H, the angles $\alpha$ and $\beta$ preferably each being between 20° and 45°.

This bearing surface 20 bears the means 5 for holding the blank 100. These means advantageously comprise indexing elements, for example by indexing with centering pins or the like, in order to position the blank correctly upon inverting it so that the second face is machined perfectly consistently with the first.

The holding means 5, in a preferred and nonlimiting embodiment of the invention, are designed to hold at least one blank 100 by a vacuum.

Advantageously, the vacuum holding operation is carried out by actuating a Venturi vacuum pump, for example of the "ML20 PIAB" type, at an orifice 21.

This workpiece holding tool 19 is designed mainly for holding a lens blank 100 in the form of a spherical cap or the like.

Preferably designed for the implementation of the machining machine 1 according to the invention, the holding tool 19 is multi-purpose and able to be adapted to other machining, finishing or monitoring means.

The holding tool 19 includes, mounted on a bearing surface 20 oblique to a mounting surface 230 that the workpiece holding tool 19 has for being mounted on a platform or on a carriage of a machine for machining blanks, and especially the ophthalmic machine 1 according to the invention, means 5 for holding this blank 100, said means being designed to hold at least one blank 100 in place by a vacuum at an orifice 21.

Positioned around this orifice 21 are, on the one hand, at least one O-ring seal 22 designed so as to be able to create a vacuum-tight volume for holding a blank 100 in place and, on the other hand, at least one fixed bearing member 221 designed so as to be able to support the same blank 100, preferably in the vicinity of the largest diameter of the latter. This O-ring seal 22, mounted on the bearing surface 20, is designed to as to be able to deform under the effect of a vacuum applied to the orifice 21 without at any moment deforming a blank 100 positioned so as to bear both on the fixed bearing member 221 and on the O-ring seal 22.

Preferably, the fixed bearing member means 221 are continuous in the form of a torus coaxial with the O-ring seal 22 or consist of touch points constituting the segment of such a torus.

Advantageously, the axial position of the O-ring seal 22 can be adjusted by adjustment means 223 in a direction normal to the bearing surface 20 and to the blank 100.

For a perfect surface finish, the holding tool 19 preferably includes at least one adjustable bearing member 222 designed so as to be able to bear on the blank 100 in the central portion of the latter.

Advantageously, the adjustment means 223 and the adjustable bearing member 222 are independent of each other.

The O-ring seal 22, in a nonlimiting embodiment, has a torus diameter of 6 mm and a 30 Shore hardness, thus making it possible to fix the blanks 100, especially lenses, directly on the workpiece holder 19, without mechanical deformation due to jaws or the like. The O-ring seal 22 is designed so as to be able to deform without at any moment deforming the blank 100.

Figure 5:
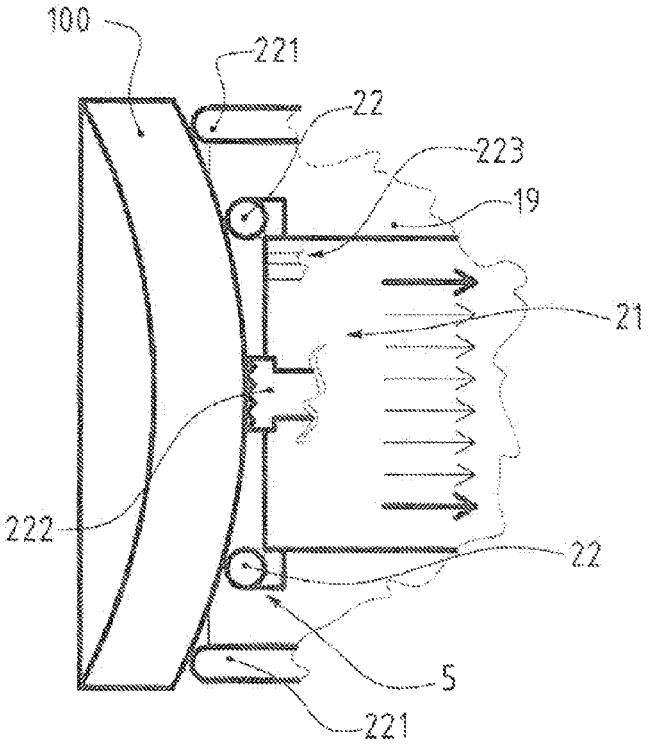
FIG. 5 is a schematic view in cross section of workpiece holding means, similar to those in FIG. 2, in one particular embodiment of the invention.
Figure 2:
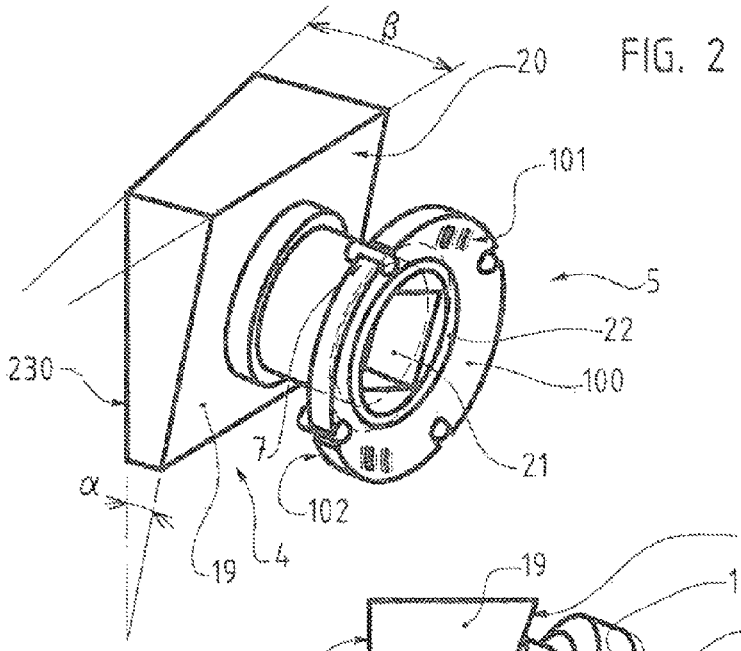
FIG. 2 is a schematic view in perspective of workpiece holding means that said machine includes.

In one advantageous embodiment, which may be seen in FIG. 5, the blank 100 bears on the O-ring seal 22, which may be made adjustable by adjustment means 223, such as a thrust ring, for example a threaded thrust ring, and on at least one fixed bearing member 221 in the vicinity of the largest diameter of the blank 100, and preferably in a region of the blank 100 that will be lost after trimming. The central portion of the blank 100 advantageously bears on an adjustable bearing member 222, in a nonmarking material, for example an elastomer, the adjustment possibly being made by a screw or by elastic return means, or the like. These provisions make it possible to damp all vibrations and enable a perfect surface finish to be achieved by machining.

The adjustable bearing member 222 is put into position automatically when positioning the blank 100, the O-ring seal 22 thus deforming in the same manner as the external seal.

The independence of the adjustments makes it possible, after a blank has been positioned so as to bear on the fixed bearing member 221, to make a first adjustment of the bearing member, by maneuvering the adjustable bearing member 222 and the adjustment means 223, in order to take account of the concavity of the blank 100, which may be carried out with a slight vacuum produced for example at a connection 231 to a vacuum pump. The definitive pressure for the machining operation is then applied, with the O-ring seal 22 being compressed under the effect of a high vacuum applied at the Venturi 21 via a connection 232 to the vacuum pump. Of course, it remains possible to modify the adjustments of the adjustable bearing member 222 and of the adjustment means 223 in order to obtain perfect holding without generating mechanical stresses within the blank, and to allow machining with a perfect surface finish according to the optical requirements.

Figure 6:
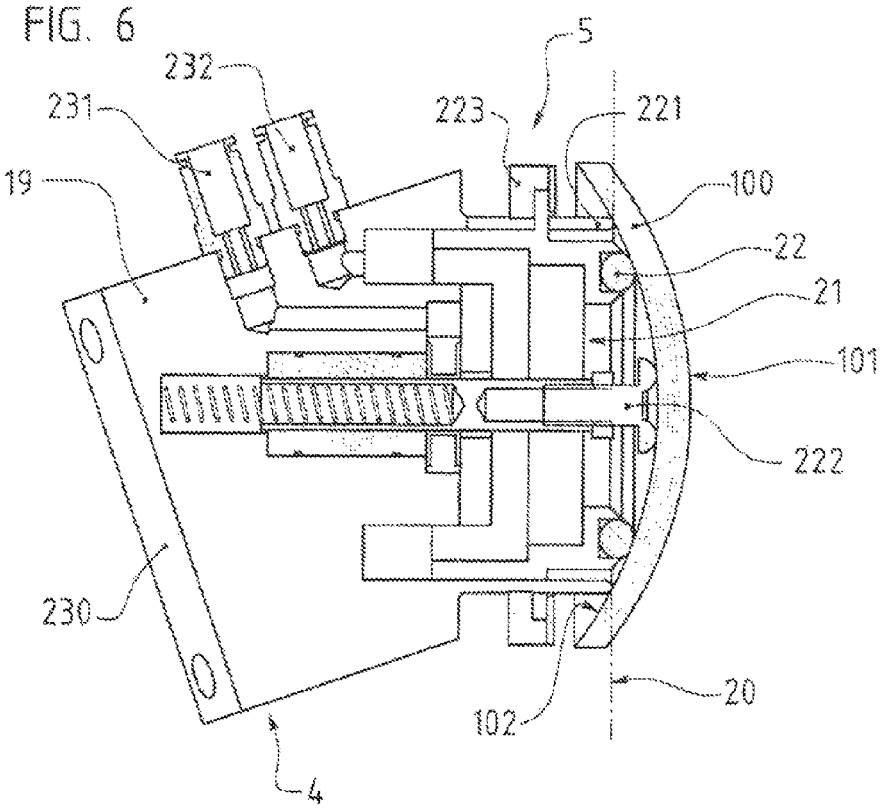
FIG. 6 is a view similar to FIG. 5 showing in detail how a blank is held in place for machining its convex face.
Figure 7:
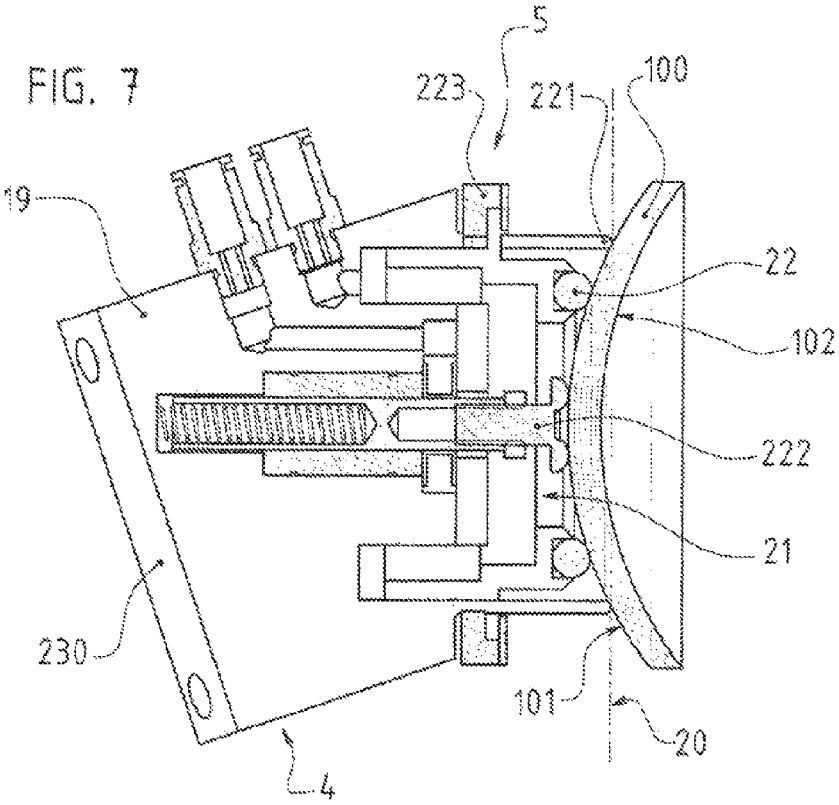
FIG. 7 is a view similar to FIG. 6 showing in detail how a blank is held in place for machining its concave face.

FIG. 6 illustrates the holding of a blank 100 presenting its convex face to the machining means and FIG. 7 illustrates the opposite case of the concave face being presented. The difference in the positioning of the adjustable bearing member 222 and the adjustment means 223 from one case to the other is clearly seen. The holding tool 19 is both multi-purpose and very compact, thereby making it possible, even on a small machining machine, to mount a panoply of holding tools 19 equipped with blanks 100.

Preferably, the ophthalmic machine 1 is equipped with at least two workpiece holders 19 and it is then possible to machine a convex surface on one of them and a concave surface on the other, with no intervention by the operator nor by a manipulator. It is also possible to produce two concave surfaces or two convex surfaces simultaneously. For example, the convex surface for a right eye and for a left eye of a pair of spectacles or lenses are machined in a single cycle, for a given customer order, and without intervention by the operator.

The system according to the invention also supports, without modification, a block lens blank, as in the existing technology.

Another way of holding the blank 100 on the oblique bearing surface 20 of the workpiece holder 19 consists in fixing onto said bearing surface, by a gripping means that it has, an insert fastened to a layer of fusible metal that follows, by using an adhesive film, the shape of one of the faces of the blank 100 on the opposite side from the face to be machined. Such a fusible metal is chosen from alloys having a low melting point, for example 47° C., so as neither to damage nor deform the blank 100 when this is a lens made of organic material.

The machining or the prior marking with marking means in order to position the blank 100 upon inverting it permits handling by a robot.

In particular in the case of optical correction lenses, the lenses may be switched over by a robot in order to machine the two faces of the lenses corresponding to the right and left eyes. In this way, the two lenses are machined on both sides. Thus, two finished prescription lenses are machined.

The ophthalmic machine 1 is equipped with an independent computer or the like, which calculates the surfaces to be machined. It is therefore possible to machine simple surfaces or else complex surfaces such as aspheric or progressive surfaces for ophthalmic optics. The machining of other surfaces is limited only by the travels of the ophthalmic machine 1.

Preferably, the computer is integrated neither into the platform 8 nor onto the ophthalmic machine 1 itself, so as to facilitate maintenance and evolution of the computing hardware.

Customarily, the method used for machining an ophthalmic lens starts with the periphery of the lens being machined and then the tool being moved along a helical path in order to complete its work travel to the center of the lens. Although this method avoids reversing the direction of movement along the axis Z of the machine, essential for machining with no surface finish defect, it does nevertheless result in a slight defect at the center of the workpiece since the differences in Z dimensions at the center are very small in value and the tool 2 must attain its dimension and simultaneously be released. In addition, this end of machining corresponds to the machining of the optical center of the workpiece, which must not have any defect.

Advantageously, and again according to one particular embodiment of the invention, the tool 2 machines a lens blank 100, for example of 66 mm diameter, by a scanning operation, moving along horizontal or vertical lines. To avoid reversing in direction along the axis Z, the blank 100 is held by a workpiece holder 19 on a bearing surface 20 inclined to the axes X and Y so that the movements along the axis Z are always in the same direction, especially positive, that is to say a machining operation is carried out with always increasing Z or else will always decreasing Z over the entire machining sequence carried out on one of the faces 101 or 102 of the blank 100. This makes it possible to prevent any impairment of the surface. Positioning a blank 100 on an inclined surface 20 is therefore particularly advantageous as regards the quality of the machining carried out.

The machining means 3 serve to etch the workpiece to be machined, which an ultrasonic head, a laser or ancillary means such as a spindle equipped with small-diameter tools may also allow. These etchings, such as barcodes, produced directly on the blanks 100, may be superficial, or within one of the faces 101 or 102, or else on another surface of the blank 100, such as its edge. Their localization by the first monitoring means 6 makes it possible to implement a specific program of machining and/or polishing, or else to start and carry out a complete recalculation of the machining and/or polishing path.

A workpiece holder 19 having an inclined bearing surface 20, as described above, results in a number of notable advantages. The fact of inclining the bearing surface 20 avoids machining on points close to the principal axis of the tool 2 and enables the latter to be used in regions where the speed is higher. The quality and the efficiency of the machining are thereby improved.

Another advantage of the bearing surface 20 being inclined along the two axes X and Y is that there is only one point of contact between the tool 2 and the surface to be machined, and most particularly by working only along three axes instead of four or even five axes. This allows recourse to a simple and inexpensive machine. On a machine tool, depending on its type, the precision of the axes is of the order of a few microns to a few tens of microns. Recourse to a fourth axis or even a fifth axis has uncertainties that have an influence on the precision of the machined workpiece. According to the invention, the tool 2 is made with a precision of the same order as that of the machine axes equipped with linear motors, and therefore three axes are sufficient for producing a surface precisely. Tool shape precision is nowadays achieved with very great exactitude, close to or equivalent to one micron. With a three-axis machine, the fact of having a variable point of contact at the tool 2, between the latter and the machined surface, does not impair the final result on the workpiece as machining errors that additional axes would cause are again obviated.

Advantageously, by inclining the bearing surface 20, the movements along the three axes cover larger distances. Thus, by avoiding the work of the slideways over the same very short distances, their wear is limited.

Another advantage of inclining the bearing surface 20 is that it makes it easier to remove chips and cutting fluid, thus making it possible to avoid any presence of chips and/or dust on the surface during machining and thus preventing any scratching on the surface. This aspect is of paramount importance for surfaces having a concave curvature. In addition, manual or automatic gripping is improved because the surface does not retain any cutting fluid. In addition, the axes X and Y on the machine are placed in a vertical plane Vxy. This principle improves the removal of chips and elimination of cutting fluid. Finally, to allow easier removal of chips, the main platform 8 has an opening 23 for their removal, or else a slope for the same purpose, placed in the machining zone. To protect the axes, no axis motor is beneath the workpiece to be machined, nor beneath the chips, and in particular the machining means 3 and the first monitoring means 6, or else the polishing means 13 are suspended beneath the secondary platform 9Z and are particularly well protected during the machining or polishing cycle.

It was mentioned above that a spiral machining operation creates a defect at the center of the lens. However, according to another feature of the invention, it is possible to use spiral machining in blank phase starting from the outside of the workpiece and then, upon arriving at the center of the surface, the machining is continued by another spiral machining operation starting from the center going toward the outside of the workpiece. The latter machining operation removes an amount of material corresponding to a finishing pass. An equation for the connection between these two spirals is integrated at the center of the workpiece with a finish pass depth.

According to another method, the final point of the spiral may also be shifted from the summit of the surface to the periphery of the workpiece, so as to minimize the abovementioned risks of machining defects.

The invention also relates to a method of machining and/or polishing an optical or ophthalmic lens blank according to the following steps:

marking means are transferred onto said blank before, during or after machining;

the position of said marking means is evaluated by the agency of monitoring means that the ophthalmic machine 1 has, these means being able to position machining means in order to machine said blank;

said blank is machined with machining means; and after machining, the lens obtained is polished with polishing means.

According to another feature of the invention with an inversion means, the lenses may be swapped around and inverted so as to machine the right eye and the left eye. In this way, the two lenses are machined on both sides. Thus, two finished prescription lenses are machined. This inversion means may be of the manual type, such as by an operator or an automatic means such as a robot.

To summarize, the invention provides novel solutions for complete manufacture of ophthalmic lenses or optical glasses, which includes machining, polishing, monitoring and identification.

The architecture design of the ophthalmic machine is far from the machines known from the prior art which comprise only rotary axes and, consequently, make any machining by scanning impossible. The choice of equipment of the ophthalmic machine of the invention with linear axes makes it possible to carry out all types of desired scanning, in particular to avoid defects at the center of the lens. The relative positioning of the axes is designed for perfect removal of the chips and machining or polishing waste, thus avoiding any damage to the workpiece during machining.

The particular design of a workpiece holding tool bearing obliquely to the reference planes defined by the system of linear axes of the machine allows scanning machining undisturbed by reversals of axes during the machining of a contour.

The invention also applies to providing vacuum holding means that are both very precise and firm on a workpiece holding tool, designed especially for preventing any deformation under stress of the blank during machining. This special workpiece holding tool is designed with an inclined bearing face in order to ensure this oblique bearing. This workpiece holding tool is designed for easy manipulation of the blanks or lenses by a manipulator such as a robot or the like, as the entire perimeter of the workpiece is free, and gripping is then facilitated. In addition, the ophthalmic machine is designed for the machining of indexing surfaces and of markings on the blank, these markings being for identification and/or referencing and/or positioning purposes, and the workpiece holding tool is designed for directly centering the blank with respect to these indexing surfaces.

The ophthalmic machine also includes means for controlling the axes of the machine, its ancillary functions and its services. These control means are interfaced with monitoring means that the machine according to the invention also includes, which means are designed so as to be able to make dimensional checks, both absolute checks and those with reference to markings made on the blank or the lens. The results of these checks are translated into deviations with respect to theoretical values and sent to the control means for very precisely controlling both the movements of manipulators for positioning or inverting the workpieces and the movements of the axes of the ophthalmic machine for the finishing machining, the polishing or the marking of the lenses.

Although primarily dedicated to the machining of flexible or rigid lenses, the invention is multi-purpose and able to be used beneficially in the field of polished surfaces, such as mirrors, flasks or the like.

The invention claimed is:

1. An ophthalmic machine for at least one of machining or polishing a lens or plastic blank, comprising:

a tool selected from the group of a machining tool and a polishing tool;

machining means for machining along a first axis and constructed for driving said tool;

workpiece supporting means having holding means disposed thereon for holding the blank in place, the blank has a first face and a second face opposite thereto;

means for inverting the blank for allowing machining on each of the faces;

said machining means being constructed for transferring markings onto the blank that can be recognized or identified by monitoring means for repositioning the blank on said holding means after an opposite face has been machined;

a main platform carrying secondary platforms, said secondary platforms carrying carriages oriented in a direct orthogonal Cartesian reference system along an X-axis, a Y-axis, and a Z-axis, the Z-axis being parallel or coincident with said first axis, said X-axis and said Z-axis defining a horizontal plane, said X-axis and said Y-axis defining a first vertical plane and said Z-axis and said Y-axis defining a second vertical plane;

said workpiece supporting means including at least one workpiece holder having an oblique support surface inclined at an angle $\alpha$ to said Y-axis in said second plane and at an angle $\beta$ to said x-axis in said horizontal plane, said support surface carrying said holding means, said angle $\alpha$ and said angle $\beta$ each being between 20° and 45°;

the machine being constructed for carrying out a machining operation along said first axis with a steadily increasing Z-value or else with a steadily decreasing Z-value over an entire machining sequence of one of the faces of the blank.

2. The ophthalmic machine as claimed in claim 1, wherein said holding means include indexing elements with centering pins, in order to position the blank correctly upon inversion thereof to machine the second face consistently with the first face.

3. The ophthalmic machine as claimed in claim 1, wherein said holding means are constructed to hold the blank by a vacuum on an O-ring seal, by actuating a Venturi vacuum pump at an orifice around which said O-ring seal is disposed on said oblique support surface, said seal is constructed to deform without deforming the blank at any time during holding.

4. The ophthalmic machine as claimed in claim 3, wherein said holding means include one or more fixed supports to support the blank in the vicinity of a largest diameter thereof, and adjustment means for adjusting a support of said O-ring seal.

5. The ophthalmic machine as claimed in claim 1, wherein said holding means include a central adjustable support in a vicinity of a center of the blank, said central support is made of a nonmarking material.

6. The ophthalmic machine as claimed in claim 1, wherein two workpiece holders are provided.

7. A workpiece holding tool for holding a lens blank in the form of a spherical cap comprising:

a mounting surface for mounting on a platform or carriage;

support surface being oblique to said mounting surface;

holding means for holding the blank, said holding means including an orifice for applying a vacuum and at least one O-ring seal surrounding said orifice for creating a vacuum-tight volume for holding the blank in place, said holding means including at least one fixed support member for supporting the blank in a vicinity of a largest diameter of the blank, said O-ring seal being constructed for deforming under the effect of a vacuum applied to said orifice without at any moment deforming the blank supported on said fixed support member and on said O-ring seal.

8. The workpiece holding tool as claimed in claim 7, further comprising adjusting means for adjusting an axial position of said O-ring seal in a direction normal to said blank.

9. The workpiece holding tool as claimed in claim 8, further comprising at least one adjustable support for resting on the blank in a central portion thereof.

10. The workpiece holding tool as claimed in claim 8, wherein said adjusting means and said adjustable support are independent of each other.

11. The ophthalmic device as claimed in claim 1, further comprising polishing means for driving at least one polishing end-piece along a second axis parallel to or coincident with said first axis, said polishing means including at least one ultrasonic head.

12. The device ophthalmic as claimed in claim 1, further comprising at least one of an etching or monitoring laser head for at least one of verifying, indexing, or monitoring said marking transferred by said machining tool.

13. A method of machining and polishing optical or ophthalmic lenses made of mineral or organic lens from a blank, comprising:

providing a device according to claim 1;

transferring markings onto the blank before, during or after machining;

positioning the blank on the holding means;

assessing a position of the markings with a control means capable of positioning the machining means along a first axis in order to machine the blank;

machining the blank with the machining means by carrying out a machining operation, parallel to the first axis, with a steadily increasing Z-value or else with a steadily decreasing Z-value over an entire machining sequence of one of the faces of the blank; and after machining, polishing each face of the lens obtained with the polishing means.

14. The method as claimed in claim 13, wherein the markings are transferred in the form of at least one of index marks or notches formed in the blank made on at least one of a first face or a second face.

* * * * *